US005380380A

United States Patent [19]

Poole et al.

[11] Patent Number: 5,380,380

[45] Date of Patent: Jan. 10, 1995

[54] IGNITION COMPOSITIONS FOR INFLATOR GAS GENERATORS

[75] Inventors: Donald R. Poole, Woodinville; Patrick C. Kwong, Seattle, both of Wash.

[73] Assignee: Automotive Systems Laboratory, Inc., Farmington Hills, Mich.

[21] Appl. No.: 193,717

[22] Filed: Feb. 9, 1994

[51] Int. Cl.[6] ..... C06B 43/00; C06B 25/34

[52] U.S. Cl. ..... 149/22; 149/36; 149/38; 149/40; 149/45; 149/62; 149/75; 149/78; 149/92

[58] Field of Search ..... 149/22, 36, 38, 40, 149/45, 62, 75, 78, 92

[56] References Cited

U.S. PATENT DOCUMENTS

| | | | |
|---|---|---|---|
| 4,733,610 | 3/1988 | Lee et al. | 149/88 |
| 4,858,951 | 8/1989 | Lenzer | 280/741 |
| 4,931,112 | 6/1990 | Wardle et al. | 149/62 |
| 5,034,072 | 7/1991 | Becuwe | 149/92 |
| 5,035,757 | 7/1991 | Poole | 149/46 |
| 5,084,118 | 1/1992 | Poole | 149/22 |
| 5,139,588 | 8/1992 | Poole | 149/61 |
| 5,256,792 | 10/1993 | Lee et al. | 548/263.8 |

*Primary Examiner*—Edward A. Miller
*Attorney, Agent, or Firm*—Lyman R. Lyon

[57] ABSTRACT

Autoigniting compositions containing a hydrazine salt of 3-nitro-1,2,4-triazole-5-one for the gas generator of a vehicle occupant restraint system result in rapid autoignition at temperatures from approximately 150° C. (302° F.) to 220° C. (428° F.) thereby allowing the gas generator to operate at lower temperatures to facilitate use of an aluminum canister. The autoignition compositions of the present invention are relatively insensitive to shock or impact, are safe to manufacture and handle, and are advantageously classified as Class B materials.

13 Claims, No Drawings

IGNITION COMPOSITIONS FOR INFLATOR GAS GENERATORS

BACKGROUND OF THE INVENTION

The present invention relates to ignition compositions, and more particularly to ignition compositions for inflator gas generators utilized in vehicle occupant restraint systems.

A steel canister is commonly utilized as the inflator pressure vessel for an automobile occupant restraint system because of the relatively high strength of steel at elevated temperatures. However, emphasis on vehicle weight reduction has renewed interest in the use of aluminum in place of steel in such pressure vessels.

One test that vehicle occupant restraint inflator systems must pass is exposure to fire whereupon the gas generating material of the inflator is expected to ignite and burn, but the inflator pressure vessel must not rupture or throw fragments. Steel pressure vessels pass this test relatively easily because steel retains most of its strength at ambient temperatures well above the temperature at which the gas generant autoignites. Aluminum, however, loses strength rapidly with increasing temperature and may not be able to withstand the combination of high ambient temperature and high internal temperature and pressure generated upon ignition of the gas generant. If, however, the gas generant of the inflator can be made to autoignite at relatively low temperatures, for example, 150° C. to 210° C. (302° F. to 410° F.), the inflator canisters can be made of aluminum.

Providing autoignition compositions for use in aluminum pressure vessels has heretofore been problematic. U.S. Pat. No. 4,561,675 granted to Adams et al., which discloses the use of Dupont 3031 single base smokeless powder as an autoignition gas generant, is exemplary of an unreliable known autoignition composition. While such smokeless powder autoignites at approximately the desired temperature of 177° C. (≈350° F.), it is largely composed of nitrocellulose. One of ordinary skill in the propellant field will appreciate that nitrocellulose is not stable for long periods at high ambient temperatures and is thus unreliable as an autoignition compound. Moreover, smokeless powder autoignites by a different mechanism than the compositions of the instant invention.

In addition, commonly assigned U.S. Pat. No. 5,084,118 to Poole describes other autoignition compositions, which comprise 5-aminotetrazole, potassium or sodium chlorate, and 2,4-dinitrophenylhydrazine. While the compositions disclosed in U.S. Pat. No. 5,084,118 autoignite and cause ignition of the gas generant when heated to approximately 177° C. (≈350° F.), the compositions have not proven to be fully satisfactory due to oversensitivity to shock or impact, while also being difficult and hazardous to manufacture. Difficulty in manufacture is further compounded because the Department of Transportation (DOT) classifies these compositions as Class A or Class 1.1 explosives and, as such, regulations require special facilities for manufacturing and storage.

SUMMARY OF THE INVENTION

The present invention solves the aforesaid problems by providing an ignition composition for an automobile occupant restraint system that will autoignite and cause ignition of the gas generant when heated to approximately 150° C. to 210° C. (302° F. to 410° F.), thereby permitting the use of an aluminum pressure vessel to contain the generant and gases produced by the generant. The compositions and processes of the present invention provide suitable insensitivity to shock and impact, while being safe to manufacture and handle. Further, the autoignition compositions of the instant invention advantageously are classified as Class B or Class 1.3 materials, and can accordingly be ground and pelletized safely in ordinary processing equipment.

DETAILED DESCRIPTION OF THE PREFERRED EMBODIMENT(S)

The autoignition compositions of the present invention comprise a hydrazine salt of nitrotriazolone, hereinafter abbreviated as HNTO, which is a thermally stable explosive that is insensitive to shock or impact. Nitrotriazolone, or NTO, may be described by two numbering systems, but the most commonly used is 3-nitro-1,2,4-triazole-5-one. It is noted for clarity of description that the "one" is not used as a number, but rather to refer to an oxygen-carbon double bond. HNTO is readily prepared by adding a stoichiometric amount of hydrazine to a solution of NTO in hot water. The NTO-hydrazine solution is heated until all of the NTO is dissolved, such as at temperatures from approximately 60° C. (140° F.) to 80° C. (176° F.). After the solution is cooled, the crystallized HNTO is filtered from the solution and then dried. By itself, HNTO functions as an autoignition material, with an autoignition temperature of approximately 230° C. (446° F.). While an autoignition composition comprising solely HNTO ignites a gas generant at a temperature suitable for some applications, the desirability of using an aluminum pressure vessel requires a preferred embodiment of the autoignition composition to autoignite at a lower temperature.

In accordance with the present invention, the ignition compositions also include additives which serve to lower the autoignition temperature of the autoignition compositions to a level which is suitable for use in an aluminum pressure vessel. These additives are included because they either reduce the initial exothermic reaction temperature and/or increase the rate of the exothermic reaction. Both of these factors result in a lower autoignition temperature. While it is difficult to determine in which manner a particular additive is beneficial, one of ordinary skill in the art will appreciate that the additives of the present invention do achieve the desired result of reducing autoignition temperatures.

In accordance with the present invention, one example of an additive that advantageously reduces autoignition temperatures is an oxidizer. For example, alkali metal nitrates, nitrites and perchlorates are preferred, particularly sodium nitrite, which results in a lower ignition temperature than many other oxidizers. Sodium nitrite is particularly effective when included in an amount within the range from a concentration of about 10% by weight to about 25% by weight. Sodium chlorate is also very effective, but is not thermally stable in combination with HNTO. Alkaline earth and certain transition metal nitrates and perchlorates may also be utilized as an oxidizer in the present invention.

Another additive that effects a further reduction in ignition temperatures is a nitrophenol, particularly picramic acid, which is similar to picric acid, but more reactive. In accordance with the teachings of the present invention, a mixture of HNTO and picramic acid is effective as an autoignition composition. However, picramic acid is a particularly useful additive when provided in mixtures with HNTO and an aforesaid oxidizer, preferably sodium nitrite. It is believed that picramic acid has two features that render it useful as an additive for reducing ignition temperatures in the present invention, namely its convenient melting point of approximately 169° C. (336° F.) as well as its high reactivity when molten.

In operation, the autoignition material must generally produce enough heat to raise a portion of the propellant to the ignition temperature. Because the autoignition material is typically packaged in a separate container, a flame extending from the autoignition container into the propellant is desirable for rapid ignition. The compositions of the present invention provide a limited energy output and, therefore, are either positioned in close proximity to the gas generant, or alternatively, near an additional ignition material. For example, small pellets or granules of a common ignition material such as $BKNO_3$ can be utilized as a booster in intimate contact with the autoignition compositions of the present invention. $BKNO_3$ is a common ignition material consisting of finely divided boron (B) and potassium nitrate ($KNO_3$), as well as a small quantity of an organic binder, and advantageously produces a very hot flame and burns rapidly when ignited. When heated to the appropriate temperature, the additional ignition material, such as $BKNO_3$, undergoes a rapid exothermic reaction which heats the material itself as well as the adjacent gas generant or ignition material to the temperature of ignition. The additional ignition material is provided in an amount sufficient to ignite the propellant, while the amount of autoignition material must be sufficient to ignite the additional ignition material.

The present invention achieves a significant advantage by providing ignition compositions that are relatively insensitive to shock and impact and are therefore relatively safe to manufacture and handle. More specifically, a mixture comprising HNTO in a concentration of 80% by weight and sodium nitrite in a concentration of 20% by weight has passed the "cap sensitivity" test required by DOT for a Class B (1.3) material and thus the materials of the present invention can be ground and pelletized safely in ordinary processing equipment.

A combination of an autoignition material and an additional booster ignition material can be attained in a single mixture by incorporating metal additives such as boron, zirconium, titanium, aluminum or other energetic materials into the HNTO/oxidizer mixture, thereby resulting in a single composition with both a higher energy output and an acceptable autoignition temperature. These mixtures, however, are generally more sensitive to impact than mixtures that do not contain metal additives.

The present invention is illustrated by the following representative examples. The following compositions are given in weight percent.

EXAMPLE 1

The hydrazine salt of 3-nitro-1,2,4-triazole-5-one (HNTO) was compression molded to form 0.125 inch diameter pellets that were approximately 0.125 inches long. 12,2T size pellets of $BKNO_3$ were placed together with four of the aforesaid pellets of HNTO in a test fixture designed to simulate an inflator assembly. It is noted that the "2T size" refers to small pellets that have a diameter of ⅛ of an inch and a length of approximately 1/16 of an inch, and wherein a total weight for 5 pellets is approximately 0.10 grams. The apparatus was then heated at a rate of approximately 60° C. (140° F.) per minute. At a temperature of 230° C. (446° F.), the mixture of pellets autoignited and caused ignition of the gas generant.

EXAMPLE 2

A mixture of HNTO and sodium nitrite ($NaNO_2$) was prepared having the following compositions: 80% HNTO and 20% $NaNO_2$.

The sodium nitrite had previously been ball-milled to reduce the particle size. The materials were mixed by dry-blending, and a 0.3 gram sample of the mixture was placed together with 5 small (2T) pellets of $BKNO_3$ in a test fixture designed to simulate an inflator assembly. The apparatus was heated at a rate of approximately 30° C. (86° F.) per minute to a temperature of 180° C. (356° F.) where the mixture autoignited and burned vigorously.

This test was repeated with the material tamped tightly into the test fixture. The mixture autoignited in 4.5 minutes at a temperature of 185° C. (365° F.).

EXAMPLE 3

A mixture of HNTO and sodium nitrite was prepared having the following composition: 90% HNTO and 10% $NaNO_2$.

The mixture was prepared and tested as described in EXAMPLE 2. At a heating rate of approximately 20° C. (68° F.) per minute, the ignition temperature was found to be 182° C. (≈360° F.). A second test, having a heating rate of approximately 43° C. (≈109° F.) per minute, gave an ignition temperature of 190° C.

EXAMPLE 4

A mixture of 75% HNTO and 25% sodium nitrite was prepared and tested as described in EXAMPLE 2. The mixture autoignited and burned at a temperature of 193° C. (≈559° F.) at a heating rate of approximately 48° C. (≈118° F.) per minute.

EXAMPLE 5

A mixture of 80% HNTO and 20% sodium nitrate ($NaNO_3$) was prepared and tested as described in EXAMPLE 2. The mixture autoignited and burned at a temperature of 213° C. (≈415° F.) at a heating rate of approximately 42° C. (≈108° F.) per minute.

EXAMPLE 6

A mixture of HNTO, sodium nitrite and picramic acid (PA) was prepared having the following composition: 72% HNTO, 18% $NaNO_2$ and 10% PA.

The sodium nitrite had previously been ball-milled to reduce the particle size. The materials were mixed by dry-blending and tested as described in EXAMPLE 2. The mixture autoignited and burned at a temperature of 157° C. (≈315° F.) at a heating rate of 32° C. (≈90° F.) per minute.

EXAMPLE 7

A mixture of HNTO, sodium nitrate and boron was prepared having the following compositions: 78% HNTO, 20% $NaNO_3$ and 2% boron.

The sodium nitrate had previously been ball-milled to reduce the particle size and amorphous boron having a particle size of 2–3 microns was used. The materials were mixed by dry-blending and thin pellets ½ inch in diameter were compression molded at a pressure of approximately 80,000 psi. The pellets were then broken up to form a granular material and 0.2 grams of this material was tested, as described in EXAMPLE 1, with satisfactory ignition results. The apparatus was heated at a rate of approximately 20° C. (68° F.) per minute to a temperature of 190° C. (374° F.) where the mixture autoignited and burned vigorously.

Example 7 demonstrates a single mixture that combines an autoignition material with an additional ignition booster material.

EXAMPLE 8

A mixture of 80% HNTO and 20% potassium perchlorate was prepared by dry-blending the powdered materials.

The potassium perchlorate had previously been ball-milled to reduce the particle size. A small sample (0.2 grams) of the mixture was placed together with 11 small (2T) pellets of $BKNO_3$ in a test fixture designed to simulate an inflator assembly. The apparatus was heated at a rate of approximately 20° C. (68° F.) per minute to a temperature of 190° C. (374° F.) where the mixture autoignited and burned vigorously.

While the preferred embodiment of the invention has been disclosed, it should be appreciated that the invention is susceptible of modification without departing from the scope of the following claims.

We claim:

1. An autoigniting composition for a gas generator of a vehicle occupant restraint system comprising a hydrazine salt of 3-nitro-1,2,4-triazole-5-one and a first additive comprising an oxidizer, wherein said composition is thermally stable when said first additive is combined with said hydrazine salt of 3-nitro-1,2,4-triazole-5-one.

2. The composition of claim 1 wherein said oxidizer is selected from the group consisting of alkali metal containing oxidizer compounds, alkaline earth metal containing oxidizer compounds, and mixtures thereof.

3. The composition of claim 1 wherein said oxidizers are selected from the group consisting of alkali metal nitrates, alkali metal nitrites, alkali metal perchlorates, alkaline earth metal nitrates, alkaline earth metal nitrites, alkaline earth metal perchlorates, and mixtures thereof.

4. The composition of claim 1 wherein said oxidizer is sodium nitrite.

5. The composition of claim 1 further comprising a second additive comprising picramic acid.

6. The composition of claim 1 further comprising an additional energetic ignition material selected from the group consisting of boron, titanium, zirconium and aluminum.

7. The composition of claim 5 further comprising an additional energetic ignition material selected from the group consisting of boron, titanium, zirconium and aluminum.

8. The composition of claim 2 wherein said hydrazine salt of 3-nitro-1,2,4-triazole-5-one is present in a concentration of from about 65% by weight to about 95% by weight and said oxidizer is sodium nitrate and is present in a concentration of from about 5% by weight to about 35% by weight.

9. The composition of claim 2 wherein said hydrazine salt of 3-nitro-1,2,4-triazole-5-one is present in a concentration of from about 65% by weight to about 95% by weight and said oxidizer is sodium nitrite and is present in a concentration of from about 5% by weight to about 35% by weight.

10. The composition of claim 2 wherein said hydrazine salt of 3-nitro-1,2,4-triazole-5-one is present in a concentration of from about 65% by weight to about 95% by weight and said oxidizer is potassium perchlorate and is present in a concentration of from about 5% by weight to about 35% by weight.

11. The composition of claim 5 wherein said hydrazine salt of 3-nitro-1,2,4-triazole-5-one is present in a concentration of from about 65% by weight to about 95% by weight, said oxidizer is selected from the group consisting of sodium nitrate, sodium nitrite, and potassium perchlorate and is present in a concentration of from about 5% by weight to about 35% by weight, and said picramic acid is present in a concentration of from about 0% by weight to about 20% by weight.

12. The composition of claim 6 wherein said hydrazine salt of 3-nitro-1,2,4-triazole-5-one is present in a concentration of from about 65% by weight to about 95% by weight, said oxidizer is selected from the group consisting of sodium nitrate, sodium nitrite, and potassium perchlorate, and is present in a concentration of from about 5% by weight to about 35% by weight, and said additional ignition material is selected from the group consisting of boron, titanium, zirconium and aluminum, and is present in a concentration of from about 0% by weight to about 10% by weight.

13. An autoigniting composition for a gas generator of a vehicle occupant restraint system comprising a hydrazine salt of 3-nitro-1,2,4-triazole-5-one and a first additive comprising picramic acid.

* * * * *